US009821214B2

(12) United States Patent
Browning

(10) Patent No.: US 9,821,214 B2
(45) Date of Patent: Nov. 21, 2017

(54) SNOWBOARD SPLITLOCK CONNECTION SYSTEMS AND METHODS

(71) Applicant: Oz Snowboards LLC, Wheat Ridge, CO (US)

(72) Inventor: Adam Browning, Arvada, CO (US)

(73) Assignee: OZ SNOWBOARDS LLC, Wheat Ridge, CO (US)

( * ) Notice: Subject to any disclaimer, the term of this patent is extended or adjusted under 35 U.S.C. 154(b) by 0 days.

(21) Appl. No.: 15/241,679

(22) Filed: Aug. 19, 2016

(65) Prior Publication Data

US 2017/0050105 A1 Feb. 23, 2017

Related U.S. Application Data

(60) Provisional application No. 62/206,960, filed on Aug. 19, 2015.

(51) Int. Cl.
*A63C 5/03* (2006.01)

(52) U.S. Cl.
CPC ..... *A63C 5/031* (2013.01)

(58) Field of Classification Search
CPC ..... A63C 5/031
See application file for complete search history.

(56) References Cited

U.S. PATENT DOCUMENTS 6,523,851 B1 * 2/2003 Maravetz ..... A63C 5/02 280/14.22
2012/0274036 A1 * 11/2012 Kloster ..... A63C 5/0411 280/11.31

FOREIGN PATENT DOCUMENTS

JP 5620597 B1 * 11/2014

* cited by examiner

*Primary Examiner* — John Walters
*Assistant Examiner* — James Triggs
(74) *Attorney, Agent, or Firm* — Snell & Wilmer L.L.P.

(57) ABSTRACT

The present disclosure provides a snowboard comprising a first splitboard ski detachably coupled to a second splitboard ski by a splitlock connection system. In various embodiments, the splitlock connection system comprising at least one of an edge connection, and at least one shear tab connection, wherein at least one of the edge connection and the shear tab connection is configured to prevent at least one of shear and relative perpendicular flexion of the first splitboard ski and the second splitboard ski.

20 Claims, 9 Drawing Sheets

SNOWBOARD SPLITLOCK CONNECTION SYSTEMS AND METHODS

CROSS-REFERENCE TO RELATED APPLICATION

This application claims priority to U.S. Provisional Patent Application Ser. No. 62/206,960, entitled "SNOWBOARD SPLITLOCK CONNECTION SYSTEMS & METHODS," filed on Aug. 19, 2015, which is incorporated herein by reference in its entirety for all purposes.

FIELD

The present disclosure relates generally to systems and methods for connecting splitboard snowboards.

BACKGROUND

Snowboarding in the backcountry entails snowboarding on ungroomed snow, for example, snowboarding on terrain not owned or maintained by a professional organization, or not groomed for snow sports using heavy equipment. Typically, backcountry snowboarders must use their own physical power to ascend a mountain on foot because conventional ski lifts are not available in the backcountry. However, ascending a mountain on foot in the snow is time-consuming and physically exhausting. Certain equipment, such as snow shoes or cross-country skis, may mitigate the difficulties of ascending a mountain on foot. However, such equipment is heavy, bulky, and difficult to transport when the user snowboards down the mountain.

Conventional splitboards are snowboards that can function in uphill mode or downhill mode. In uphill mode, splitboards break into two sections that can be used like cross country skis to facilitate a backcountry snowboarder's travel up a mountain. Once ascent is complete, the two sections of the splitboard can be clipped together with specialized connection hardware to convert the splitboard into downhill mode, enabling the user to snowboard down the mountain.

Conventional splitboards function as two separate skis that bind together at two connection points to form a snowboard. However, these skis still function separately of each other in downhill mode. As the snowboarder travels downhill, the skis flex against each other everywhere except the two connection points. Such flexing creates high and low points in the middle of the splitboard that catch the snow and cause unpredictable movements, loss of control, and inconsistent flex patterns. As a result, the conventional splitboards ride in an inconsistent fashion. In addition, flexing of skis creates shear forces that cause the connection hardware to vibrate. Such vibration may cause the connection hardware to fail unexpectedly by becoming loose or separating completely during use in downhill mode.

SUMMARY

In various embodiments, the present disclosure provides a snowboard comprising a first splitboard ski detachably coupled to a second splitboard ski by a splitlock connection system. In various embodiments, the splitlock connection system comprises at least one of an edge connection, and at least one shear tab connection, wherein at least one of the edge connection and the shear tab connection is configured to prevent at least one of shear and relative perpendicular flexion of the first splitboard ski and the second splitboard ski.

In various embodiments, the snowboard further comprises a serrated edge disposed on a first interior sidewall of an inner edge of at least one of the first splitboard ski and the second splitboard ski. In various embodiments, the edge connection extends at least partially between a first end of the snowboard and a second end of the snowboard. In various embodiments, the edge connection comprises a first edge profile disposed on a first interior sidewall of the first splitboard ski, and a second edge profile disposed on a second interior sidewall of the second splitboard ski, wherein the first edge profile comprises a shape complimentary to the second edge profile. In various embodiments, the edge connection comprises as least one of a bevel connection, a step connection, a notch connection, a knob connection, a v-nose connection, a round connection, and a tab and notch connection.

In various embodiments, the edge connection comprises a twist lock connection. In various embodiments, the twist lock connection comprises at least one twist lock notch disposed between a top surface and a bottom surface of the first splitboard ski and extending laterally from the first interior sidewall of the first splitboard ski, at least one twist lock pin disposed in the at least one notch and extending perpendicularly, and at least one twist lock disposed at the second interior sidewall of the second splitboard ski, wherein, in response to being rotated, the at least one twist lock is configured to at least partially insert into the at least one twist lock notch and detachably couple the twist lock to the at least one twist lock pin.

In various embodiments, the shear tab connection comprises a shear tab coupled to the first splitboard ski and extending laterally over an inner edge of the first splitboard ski, and at least one shear pin detachably coupled to the shear tab and the second splitboard ski. In various embodiments, the shear tab is disposed on a top surface of the snowboard. In various embodiments, the snowboard further comprises an inset portion disposed on a top surface of the snowboard, wherein the shear tab is disposed in the inset portion. In various embodiments, the shear tab is disposed on a central portion of the snowboard.

In various embodiments, the present disclosure provides a snowboard comprising a first splitboard ski detachably coupled to a second splitboard ski by a splitlock connection system. In various embodiments, the splitlock connection system comprises at least one of an edge connection, and at least one pin and bore connection, wherein at least one of the edge connection and the pin and bore connection is configured to prevent at least one of shear and relative perpendicular flexion of the first splitboard ski and the second splitboard ski.

In various embodiments, the snowboard further comprises a serrated edge disposed on an interior sidewall of at least one of the first splitboard ski and the second splitboard ski. In various embodiments, the edge connection extends at least partially between a first end of the snowboard and a second end of the snowboard. In various embodiments, the edge connection comprises a first edge profile disposed on a first interior sidewall of the first splitboard ski, and a second edge profile disposed on a second interior sidewall of the second splitboard ski, wherein the first edge profile comprises a shape complimentary to the second edge profile. In various embodiments, the edge connection comprises as least one of a bevel connection, a step connection, a notch connection, a knob connection, a v-nose connection, a round connection, a tab and notch connection, and a twist lock connection.

In various embodiments, the pin and bore connection comprises a pin tab coupled to the first splitboard ski at an interior sidewall of the first splitboard ski, wherein the pin tab comprises a protruding pin extending longitudinally along the snowboard, and a bore tab coupled to the second splitboard ski at an interior sidewall of the second splitboard ski, wherein the bore tab comprises a bore extending longitudinally along the snowboard, wherein the protruding pin comprises a shape complementary to the bore, and wherein, in response to at least partially inserting the protruding pin into the bore, the first splitboard ski is detachably coupled to the second splitboard ski. In various embodiments, the pin and bore connection is disposed on a top surface of the snowboard.

In various embodiments, the snowboard further comprises an inset portion disposed on a top surface of the snowboard, wherein the pin and bore connection is disposed in the inset portion. In various embodiments, a first pin and bore connection is disposed on a first end of the snowboard, and a second pin and bore connection is disposed on a second end of the snowboard.

In various embodiments, the present disclosure provides a snowboard comprising a first splitboard ski detachably coupled to a second splitboard ski by a splitlock connection system, the splitlock connection system comprising at least one of an edge connection, at least one shear tab, at least one pin and bore connection, and at least one serrated edge.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

Figure 1:
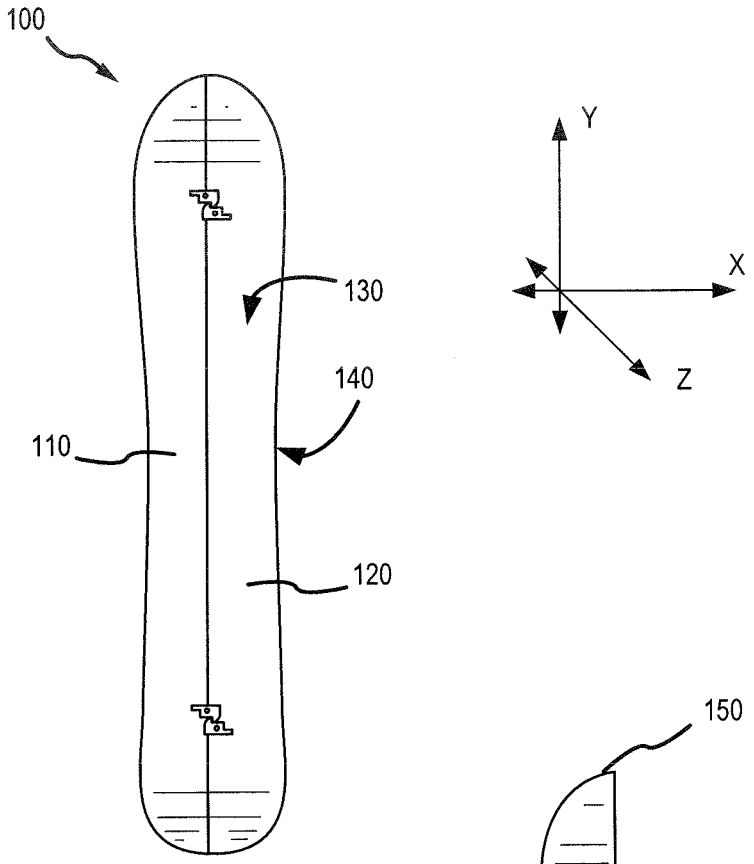
FIG. 1 illustrates a top view of a splitboard snowboard in downhill mode in accordance with various embodiments.
Figure 2:
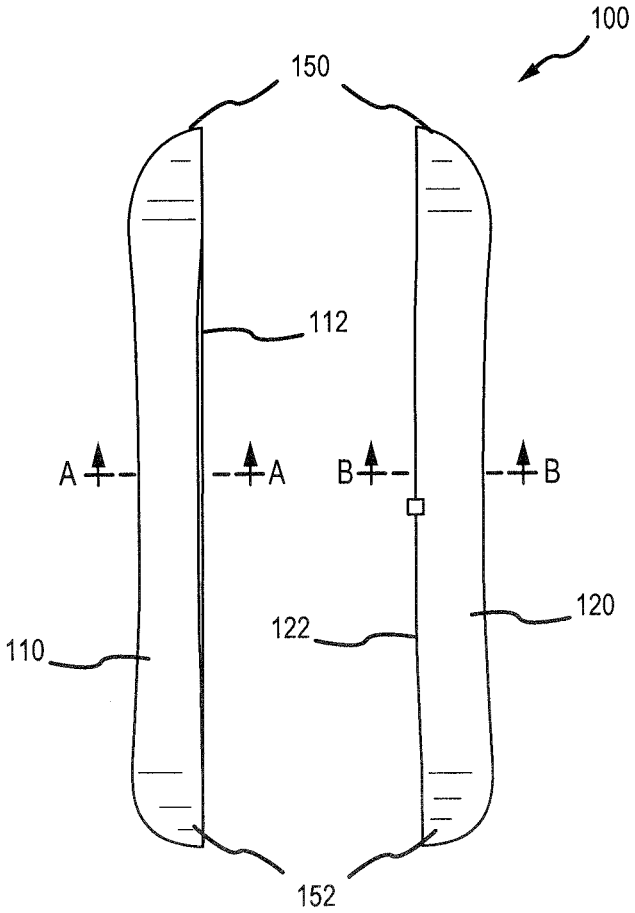
FIG. 2 illustrates a top view of a splitboard snowboard in uphill mode in accordance with various embodiments.

In various embodiments and with reference to FIGS. 1 and 2, the present disclosure provides a splitboard snowboard 100 comprising a first splitboard ski 110 and a second splitboard ski 120. The first splitboard ski 110 and the second splitboard ski 120 may be detachably coupled such that they may function separately as skis or together as a snowboard. As used herein and with reference to FIG. 2, the term uphill mode refers to a configuration of the splitboard snowboard 100 wherein the first splitboard ski 110 and the second splitboard ski 120 are detached and the splitboard snowboard 100 is configured for cross-country or uphill travel; with reference to FIG. 1, the term downhill mode refers to a configuration of the splitboard snowboard 100 wherein the first splitboard ski 110 and the second splitboard ski 120 are coupled and the splitboard snowboard 100 is configured for downhill travel.

As used herein, the term longitudinal refers to a direction along the long axis or Y axis of the splitboard snowboard 100; the term lateral refers to a direction along the short axis or X axis of the splitboard snowboard 100. In various embodiments, during use of the splitboard snowboard 100 the first splitboard ski 110 may translate longitudinally relative to the second splitboard ski 120. Such translation may be referred to herein as shear. As used herein, the terms perpendicular and perpendicularly refer to a direction perpendicular to a top surface 130 and a bottom surface 140 of the splitboard snowboard 100, or along the Z axis of the splitboard snowboard 100. In various embodiments, during use of the splitboard snowboard 100, pressure from the ground, snow, ice, or rider may cause flexion of the first splitboard ski 110 or the second splitboard ski 120 in a perpendicular direction.

In various embodiments, a splitboard snowboard 100 may comprise a splitlock connection system configured to detachably couple the first splitboard ski 110 and the second splitboard ski 120. In various embodiments, the splitlock connection system may cause the flex of the splitboard snowboard to translate throughout the entire connected splitboard snowboard in downhill mode to allow the user more control and consistent performance. Stated differently, in various embodiments, the splitlock connection system may prevent relative perpendicular flexion of the first splitboard ski 110 and the second splitboard ski 120. In various embodiments, the splitlock connection system may prevent or minimize shear between the first splitboard ski 110 and the second splitboard ski 120.

In various embodiments and with reference again to FIG. 2, the splitlock connection system may comprise an edge connection. In various embodiments, the edge connection may extend at least partially between a first end 150 of the splitboard snowboard 100 and a second end 152 of the splitboard snowboard 100. In various embodiments, the edge connection may extend the entire distance from a first end 150 of the splitboard snowboard 100 to a second end 152 of the splitboard snowboard 100. However, in various embodiments, the edge connection may extend any distance from a first end 150 of the splitboard snowboard 100 to a second end 152 of the splitboard snowboard 100. Although various embodiments are disclosed herein, one skilled in the art will appreciate that in various embodiments, the edge connection may comprise any shape or configuration suitable for preventing or minimizing relative perpendicular flexion of the first splitboard ski 110 and the second splitboard ski 120. By way of example, an edge connection profile may vary from a first end 150 of the splitboard snowboard 100 to a second end 152 of the splitboard snowboard 100, for example, change in shape or configuration. In various embodiments, a splitboard ski may comprise a plurality of edge connections having the same shape or configuration. In various embodiments, a splitboard ski may comprise a plurality of edge connections having different shapes or configurations.

In various embodiments, the edge connection may comprise a first edge profile disposed on a first interior sidewall 112 of the first splitboard ski 110. In various embodiments, the edge connection may further comprise a second edge profile disposed on a second interior sidewall 122 of the second splitboard ski 120. In various embodiments, the first edge profile may comprise a shape complimentary to the second edge profile such that the first edge profile disposed on the first interior sidewall 112 of the first splitboard ski 110 comes into contact with the second edge profile disposed on the second interior sidewall 122 of the second splitboard ski 120 when the first splitboard ski 110 is detachably coupled to the second splitboard ski 120. Edge connections in accordance with various embodiments will now be described with reference to FIGS. 3-8, which illustrate cross sectional views of the exemplary splitboard snowboard depicted by FIG. 2.

Figure 3:
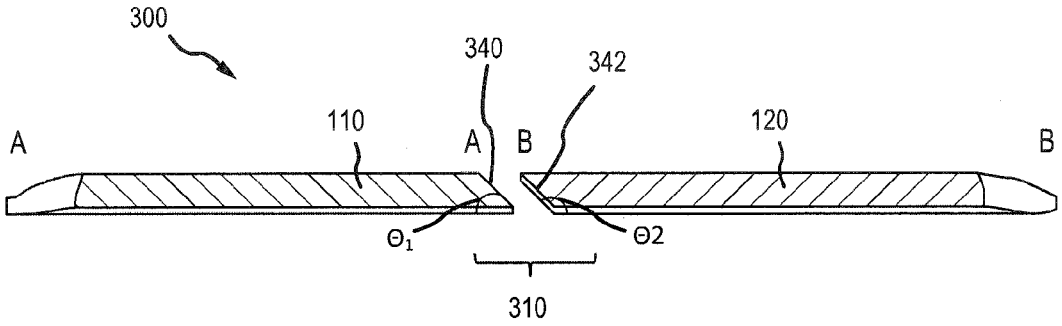
FIG. 3 illustrates a cross sectional view of a splitboard snowboard with a bevel edge connection in accordance with various embodiments.

In various embodiments and with reference to FIG. 3, the edge connection of a splitboard snowboard 300 may comprise a bevel connection 310. In various embodiments, the bevel will be cut so each interior sidewall has an opposing cut angle to the other. The purpose of the bevel connection is to lock the first splitboard ski and the second splitboard ski together during downhill mode to eliminate the relative perpendicular flexion that may occur when riding a splitboard snowboard in downhill mode. In various embodiments, the bevel connection 310 may comprise a first edge profile 340 and a second edge profile 342. In various embodiments, the first edge profile 340 and the second edge profile 342 may comprise an edge disposed at a non-perpendicular angle. In various embodiments, a first angle $\theta_1$ may comprise an angle supplementary to a second angle $\theta_2$. In various embodiments, the first angle $\theta_1$ may comprise an angle of 68 degrees and the second angle $\theta_2$ may comprise an angle of 112 degrees. In various embodiments, the first angle $\theta_1$ may comprise an angle of about 22 degrees (+/−4 degrees) to about 85 degrees (+/−4 degrees). In various embodiments, the second angle $\theta_2$ may comprise an angle of about 158 degrees (+/−4 degrees) to about 95 degrees (+/−4 degrees). However, in various embodiments, the first angle $\theta_1$ and the second angle $\theta_2$ may comprise any angles suitable for use in the bevel connection 310. In various embodiments, the complementarity of the first edge profile 340 and the second edge profile 342 may decrease or minimize relative perpendicular flexion of the first splitboard ski 110 and the second splitboard ski 120.

In various embodiments, the splitboard snowboard may comprise a bevel connection and a shear tab connection (described below). In various embodiments, the splitboard snowboard may comprise a bevel connection and a pin and bore connection (described below). In various embodiments, at least one of the bevel connection, shear tab connection, and the pin and bore connection translates the forces of riding downhill across the entire plane of the splitboard snowboard that is connected.

Figure 4:
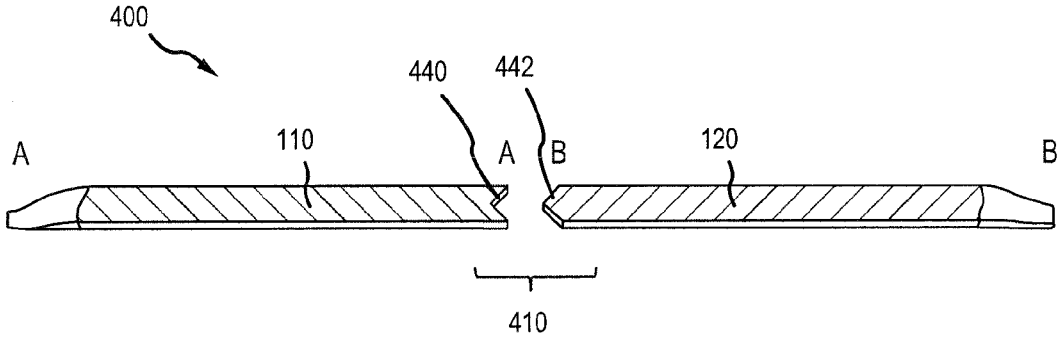
FIG. 4 illustrates a cross sectional view of a splitboard snowboard with a v-nose edge connection in accordance with various embodiments.

In various embodiments and with reference to FIG. 4, the edge connection of a splitboard snowboard 400 may comprise a v-nose connection 410. In various embodiments, the v-nose connection will be cut so each interior sidewall face has an opposing cut angle to the other. In various embodiments, the purpose of the v-nose and shear tab connection is to lock the first splitboard ski and the second splitboard ski together during downhill mode to eliminate the relative perpendicular flexion that occurs during riding a splitboard snowboard in downhill mode. In various embodiments, the v-nose connection 410 may comprise a first edge profile 440 and a second edge profile 442. In various embodiments, the first edge profile 440 may comprise two non-perpendicular edges configured to define a concave depression. In various embodiments, the second edge profile 442 may comprise two non-perpendicular edges configured to define a convex boss. In various embodiments, the first edge profile 440 may comprise a shape complementary to the second edge profile 442. In various embodiments, the complementarity of the first edge profile 440 and the second edge profile 442 may decrease or minimize relative perpendicular flexion of the first splitboard ski 110 and the second splitboard ski 120.

In various embodiments, the splitboard snowboard may comprise a v-nose connection and a shear tab connection (described below). In various embodiments, the splitboard snowboard may comprise a v-nose connection and a pin and bore connection (described below). In various embodiments, at least one of the v-nose connection, shear tab connection, and the pin and bore connection translates the forces of riding downhill across the entire plane of the splitboard snowboard that is connected.

Figure 5:
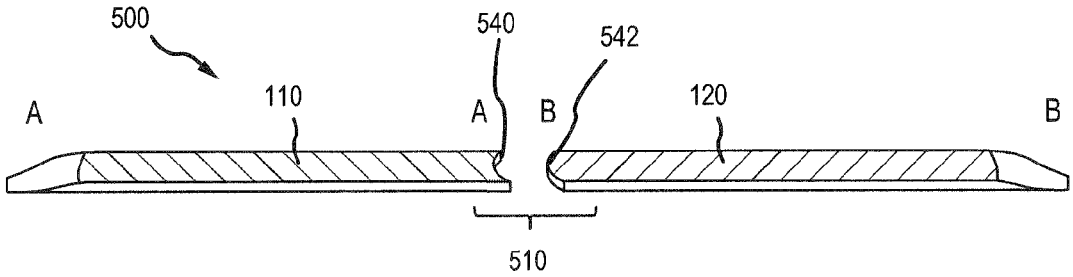
FIG. 5 illustrates a cross sectional view of a splitboard snowboard with a round edge connection in accordance with various embodiments.

In various embodiments and with reference to FIG. 5, the edge connection of a splitboard snowboard 500 may comprise a round connection 510. In various embodiments, the round connection will be cut so each interior sidewall face has an opposing cut angle to the other. In various embodiments, the purpose of the round connection is to lock the first splitboard ski and the second splitboard ski together during downhill mode to eliminate the relative perpendicular flexion that occurs during riding a splitboard snowboard in downhill mode. In various embodiments, the round connection 510 may comprise a first edge profile 540 and a second edge profile 542. In various embodiments, the first edge profile 540 may comprise a curved edge configured to define a concave depression. In various embodiments, the second edge profile 542 may comprise a curved edge configured to define a convex boss. In various embodiments, the first edge profile 540 may comprise a shape complementary to the second edge profile 542. In various embodiments, the complementarity of the first edge profile 540 and the second edge profile 542 may decrease or minimize relative perpendicular flexion of the first splitboard ski 110 and the second splitboard ski 120.

In various embodiments, the splitboard snowboard may comprise a round connection and a shear tab connection (described below). In various embodiments, the splitboard snowboard may comprise a round connection and a pin and bore connection (described below). In various embodiments, at least one of the round connection, shear tab connection, and the pin and bore connection translate the forces of riding downhill across the entire plane of the splitboard snowboard that is connected.

Figure 6:
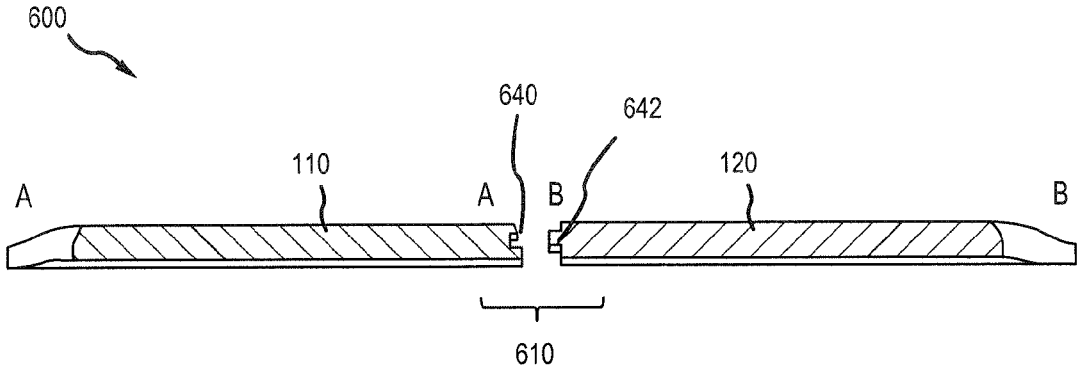
FIG. 6 illustrates a cross sectional view of a splitboard snowboard with a notch edge connection in accordance with various embodiments.

In various embodiments and with reference to FIG. 6, the edge connection of a splitboard snowboard 600 may comprise a notch connection 610. In various embodiments, the notch connection will be cut so each interior sidewall face has an opposing cut angle to the other. In various embodiments, the purpose of the notch connection and shear tab connection is to lock the first splitboard ski and the second splitboard ski together during downhill mode to eliminate the relative perpendicular flexion that occurs during riding a splitboard snowboard in downhill mode. In various embodiments, the notch connection 610 may comprise a first edge profile 640 and a second edge profile 642. In various embodiments, the first edge profile 640 may comprise a rectangular depression extending longitudinally between the first end 150 and the second end 152 (with momentary reference to FIG. 2). In various embodiments, the second edge profile 642 may comprise a rectangular boss extending longitudinally between the first end 150 and the second end 152 (with momentary reference to FIG. 2). In various embodiments, the first edge profile 640 may comprise a shape complementary to the second edge profile 642. In various embodiments, the complementarity of the first edge profile 640 and the second edge profile 642 may decrease or minimize relative perpendicular flexion of the first splitboard ski 110 and the second splitboard ski 120.

In various embodiments, the splitboard snowboard may comprise a notch connection and a shear tab connection (described below). In various embodiments, the splitboard snowboard may comprise a notch connection and a pin and bore connection (described below). In various embodiments, at least one of the notch connection, shear tab connection, and the pin and bore connection translates the forces of riding downhill across the entire plane of the splitboard snowboard that is connected.

Figure 7:
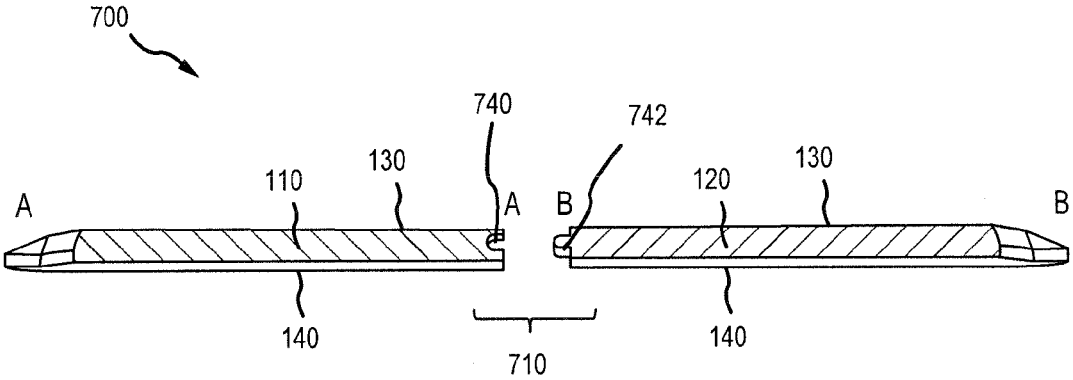
FIG. 7 illustrates a cross sectional view of a splitboard snowboard with a knob edge connection in accordance with various embodiments.

In various embodiments and with reference to FIG. 7, the edge connection of a splitboard snowboard 700 may comprise a knob connection 710. In various embodiments, the knob will be cut so each interior sidewall face has an opposing cut angle to the other. In various embodiments, the purpose of the knob connection and shear tab connection is to lock the first splitboard ski and the second splitboard ski together during downhill mode to eliminate the relative perpendicular flexion that occurs during riding a splitboard snowboard in downhill mode. In various embodiments, the knob connection 710 may comprise a first edge profile 740 and a second edge profile 742. In various embodiments, the first edge profile 740 may comprise a curved edge extending partially between the top surface 130 and the bottom surface 140 of the first splitboard ski 110 and configured to define a concave depression. In various embodiments, the second edge profile 742 may comprise a curved edge extending partially between the top surface 130 and the bottom surface 140 of the second splitboard ski 120 and configured to define a convex depression. In various embodiments, the first edge profile 740 may comprise a shape complementary to the second edge profile 742. In various embodiments, the complementarity of the first edge profile 740 and the second edge profile 742 may decrease or minimize relative perpendicular flexion of the first splitboard ski 110 and the second splitboard ski 120.

In various embodiments, the splitboard snowboard may comprise a knob connection and a shear tab connection (described below). In various embodiments, the splitboard snowboard may comprise a knob connection and a pin and bore connection (described below). In various embodiments, at least one of the knob connection, shear tab connection, and the pin and bore connection translate the forces of riding downhill across the entire plane of the splitboard snowboard that is connected.

Figure 8:
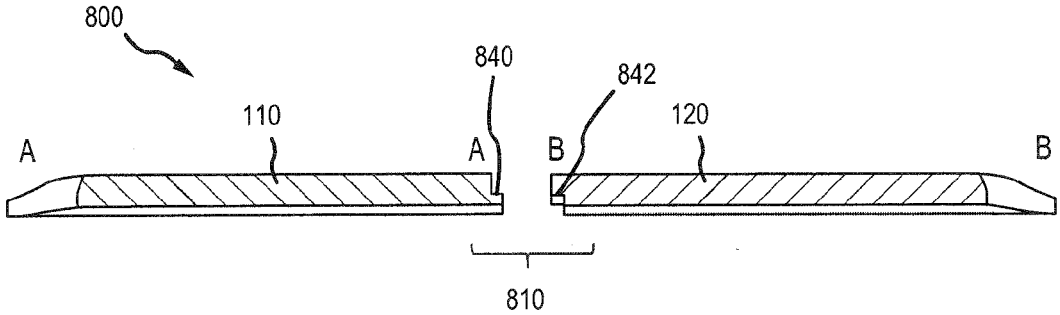
FIG. 8 illustrates a cross sectional view of a splitboard snowboard with a step edge connection in accordance with various embodiments.

In various embodiments and with reference to FIG. 8, the edge connection of a splitboard snowboard 800 may comprise a step connection 810. In various embodiments, the step will be cut so each sidewall face has an opposing cut angle to the other. In various embodiments, the purpose of the step connection and shear tab connection is to lock the first splitboard ski and the second splitboard ski together during downhill mode to eliminate the relative perpendicular flexion that occurs during riding a splitboard snowboard in downhill mode. In various embodiments, the step connection may comprise a first edge profile 840 and a second edge profile 842. In various embodiments, the first edge profile 840 may comprise a ledge wherein a lower portion of the first splitboard ski 110 extends laterally beyond an upper portion of the first splitboard ski 110. In various embodiments, the second edge profile 842 may comprise a ledge wherein an upper portion of the second splitboard ski 120 extends laterally beyond a lower portion of the second splitboard ski 120. In various embodiments, the first edge profile 840 may comprise a shape complementary to the second edge profile 842. In various embodiments, the complementarity of the first edge profile 840 and the second edge profile 842 may decrease or minimize relative perpendicular flexion of the first splitboard ski 110 and the second splitboard ski 120.

In various embodiments, the splitboard snowboard may comprise a step connection and a shear tab connection (described below). In various embodiments, the splitboard snowboard may comprise a step connection and a pin and bore connection (described below). In various embodiments, at least one of the step connection, shear tab connection, and the pin and bore connection translates the forces of riding downhill across the entire plane of the splitboard snowboard that is connected.

Figure 9A:
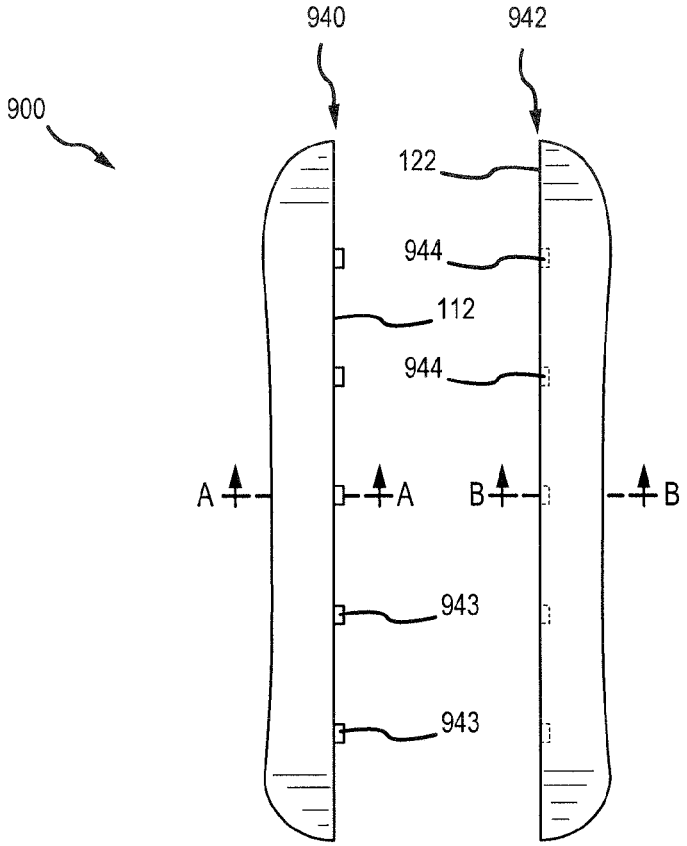
FIG. 9A illustrates a top view of a splitboard snowboard having a tab and notch connection in uphill mode in accordance with various embodiments.
Figure 9B:
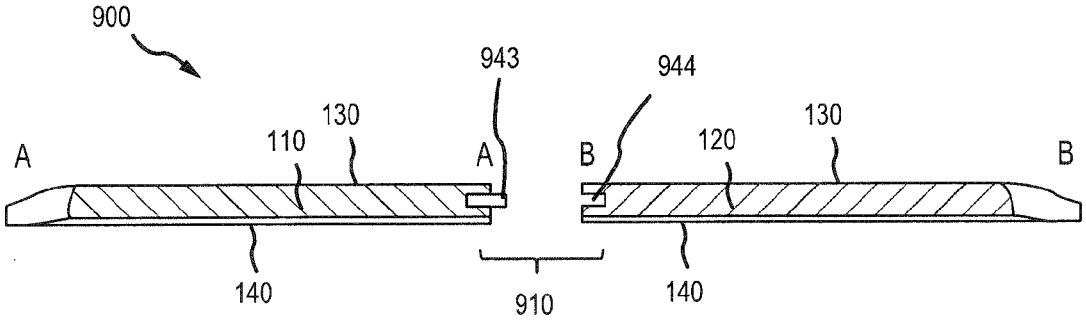
FIG. 9B illustrates a cross sectional view of FIG. 9A in accordance with various embodiments.

In various embodiments and with reference to FIGS. 9A and 9B, the edge connection of a splitboard snowboard 900 may comprise a tab and notch connection 910. In various embodiments, the tab and notch connection will be cut so each sidewall face has an opposing cut angle to the other. In various embodiments, the purpose of the tab and notch connection and shear tab connection is to lock the first splitboard ski and the second splitboard ski together during downhill mode to eliminate shear and/or the relative perpendicular flexion that occurs during riding a splitboard snowboard in downhill mode. In various embodiments, the tab and notch connection 910 may comprise a first edge profile 940 and a second edge profile 942. In various embodiments, the first edge profile 940 may comprise a plurality of tabs 943 disposed between the top surface 130 and the bottom surface 140 of the first splitboard ski 110 and extending laterally from the first interior sidewall 112 of the first splitboard ski 110. In various embodiments, the second edge profile 942 may comprise a plurality of depressions 944 disposed between the top surface 130 and the bottom surface 140 of the second splitboard ski 120 and extending laterally from the second interior sidewall 122 of the second splitboard ski 120.

In various embodiments, the plurality of tabs 943 and the plurality of depressions 944 may comprise a rectangular shape. In various embodiments, the plurality of tabs 943 and the plurality of depressions 944 may comprise a rounded shape. In various embodiments, the plurality of tabs 943 and the plurality of depressions 944 may comprise a beveled, v-nose, knob, and/or step shape, as previously described in the context of the various edge connections disclosed herein. However, in various embodiments, the plurality of tabs 943 and the plurality of depressions 944 may comprise any shape suitable for use in the tab and notch connection 910. In various embodiments, the first edge profile 940 may comprise a shape complementary to the second edge profile 942. In various embodiments, the complementarity of the first edge profile 940 and the second edge profile 942 may decrease or minimize relative perpendicular flexion of the first splitboard ski 110 and the second splitboard ski 120.

In various embodiments, the splitboard snowboard may comprise a tab and notch connection and a shear tab connection (described below). In various embodiments, the splitboard snowboard may comprise a tab and notch connection and a pin and bore connection (described below). In various embodiments, at least one of the tab and notch connection, shear tab connection, and the pin and bore connection translates the forces of riding downhill across the entire plane of the splitboard snowboard that is connected.

Figure 10A:
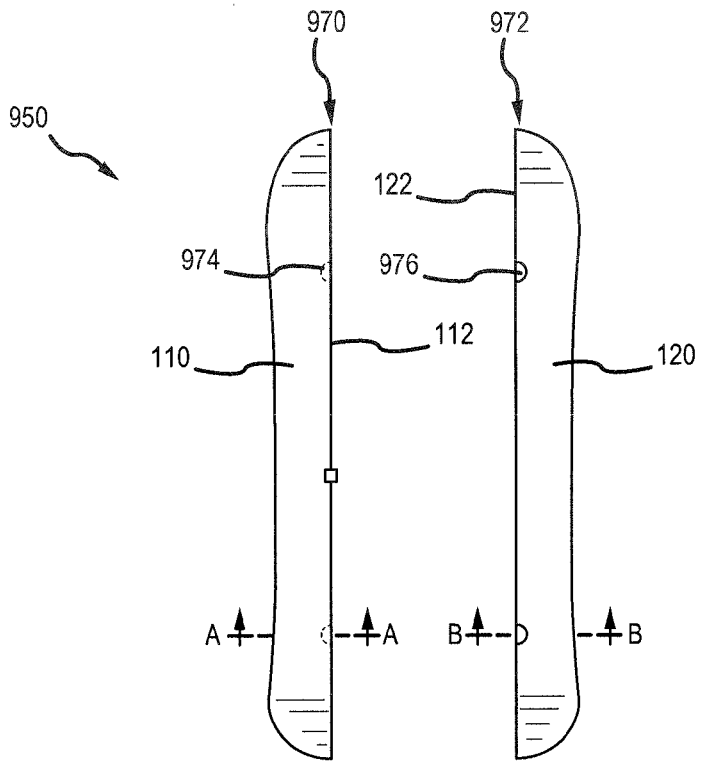
FIG. 10A illustrates a top view of a splitboard snowboard having a twist lock connection in uphill mode in accordance with various embodiments.
Figure 10B:
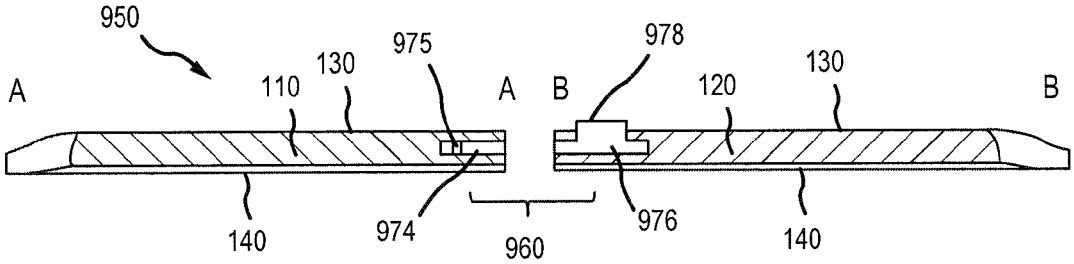
FIG. 10B illustrates a cross sectional view of FIG. 10A in accordance with various embodiments.

In various embodiments and with reference to FIGS. 10A and 10B, the edge connection of a splitboard snowboard 950 may comprise a twist lock connection 960. In various embodiments, the twist lock connection may be configured to turn and lock the first splitboard ski and the second splitboard ski to create one splitboard snowboard for use in downhill mode. In various embodiments, the purpose of the twist lock and shear tab connection is to lock the first splitboard ski and the second splitboard ski together during downhill mode to eliminate the shear and the relative perpendicular flexion that occurs during riding a splitboard snowboard in downhill mode.

In various embodiments, the twist lock connection 960 may comprise a first edge profile 970 and a second edge profile 972. In various embodiments, the first edge profile 970 may comprise at least one twist lock notch 974. However, in various embodiments, the first edge profile 970 may comprise a plurality of twist lock notches. In various embodiments, the twist lock notch 974 may comprise a depression disposed between the top surface 130 and the bottom surface 140 of the first splitboard ski 110 and extending laterally from the first interior sidewall 112 of the first splitboard ski 110. In various embodiments, the twist lock notch 974 may comprise a hemispherical shape. However, in various embodiments, the twist lock notch 974 may comprise any shape suitable for use in the twist lock connection 960.

In various embodiments, the twist lock notch 974 may further comprise a twist lock pin 975. In various embodiments, the twist lock pin 975 may be disposed in the twist lock notch 974 and may extend through the twist lock notch 974 perpendicularly. In various embodiments, the twist lock pin 975 may be configured to detachably couple to a twist lock 976.

In various embodiments, the second edge profile 972 may comprise at least one twist lock 976. However, in various embodiments, the second edge profile 972 may comprise a plurality of twist locks. In various embodiments, the twist lock 976 may comprise rotating portion 977 rotatable in a plane substantially parallel to the top surface 130 and the bottom surface 140 of the second splitboard ski 120. In various embodiments, the rotating portion 977 may comprise a hemispherical shape. However, in various embodiments, the rotating portion 977 may comprise any shape suitable for use in a twist lock connection 960. In various embodiments, the rotating portion 977 may comprise a locking portion 979 (with momentary reference to FIGS. 11A and 11B. The locking portion 979 may be configured to detachably couple to the lock pin 975

In various embodiments, the rotating portion 977 may rotate in response to rotation of a rotation handle 978. In various embodiments, the rotation handle 978 may be coupled to the rotating portion 977 and disposed above rotating portion 977 such that a user may access the rotation handle 978 from the top surface 130 of the second splitboard ski 120. In various embodiments, the rotation handle 978 may comprise a boss or protrusion from the twist lock 976. In various embodiments, the rotation handle 978 may comprise a depression in the twist lock 976. However, in various embodiments, the rotation handle 978 may comprise any shape or configuration suitable for use in the split lock connection 960.

Figure 11A:
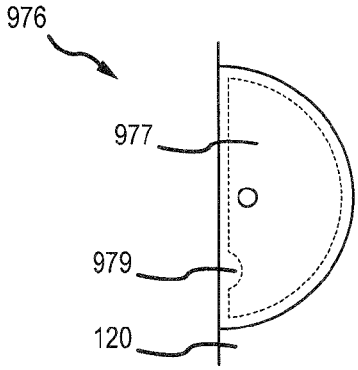
FIGS. 11A and 11B illustrate top views of a twist lock connection in accordance with various embodiments.
Figure 11B:
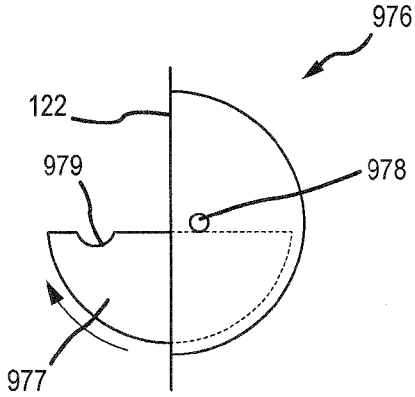

In various embodiments, and with reference to FIGS. 11A and 11B, rotating portion 977 may be containable or concealable within the second splitboard ski 120. In various embodiments, upon rotation of the rotation handle 978, at least a portion of rotating portion 977 may extend laterally from the second interior sidewall 122 of the second splitboard ski 120. In various embodiments, rotation of the rotating portion 977 may cause the locking portion 979 to detachably couple to the lock pin 975 (with momentary reference to FIG. 10 B). In various embodiments, the locking portion 979 may be configured to create a friction fit with the lock pin 975. However, in various embodiments, the locking portion 979 may be configured to detachably couple to the lock pin 975 by magnetic, adhesive, mechanical, electromagnetic, or any other suitable means.

In various embodiments, the splitboard snowboard may comprise a twist lock connection and a shear tab connection (described below). In various embodiments, the splitboard snowboard may comprise a twist lock connection and a pin and bore connection (described below). In various embodiments, at least one of the twist lock connection, shear tab connection, and the pin and bore connection translates the forces of riding downhill across the entire plane of the splitboard snowboard that is connected.

Figure 12:
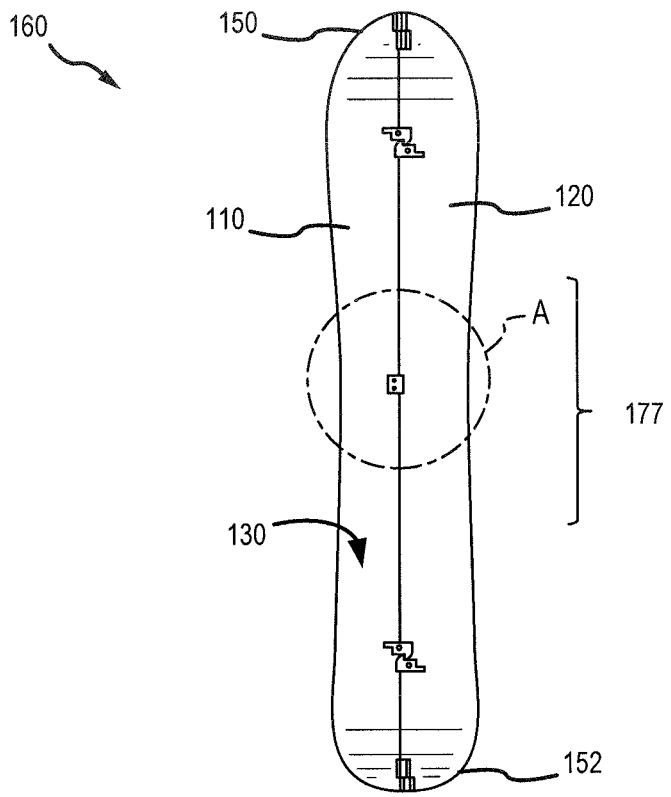
FIG. 12 illustrates a top view of a splitboard snowboard having a shear tab connection in downhill mode in accordance with various embodiments.
Figure 13A:
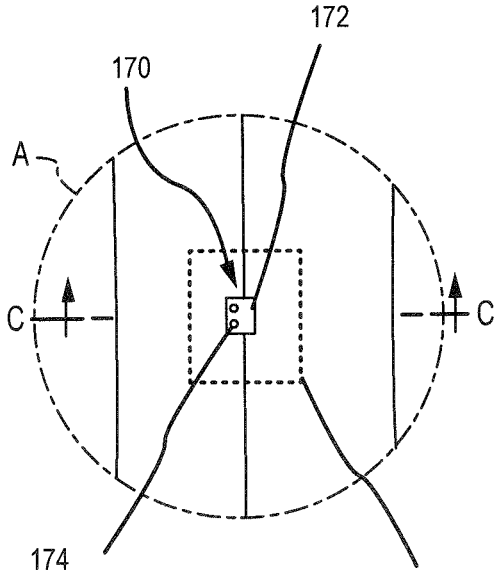
FIG. 13A illustrates a close up view of FIG. 12 in accordance with various embodiments.
Figure 13B:
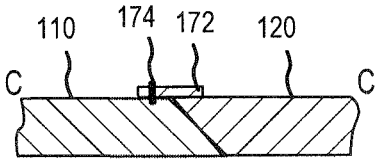
FIG. 13B illustrates a cross sectional view of a FIG. 13A in accordance with various embodiments.
Figure 14:
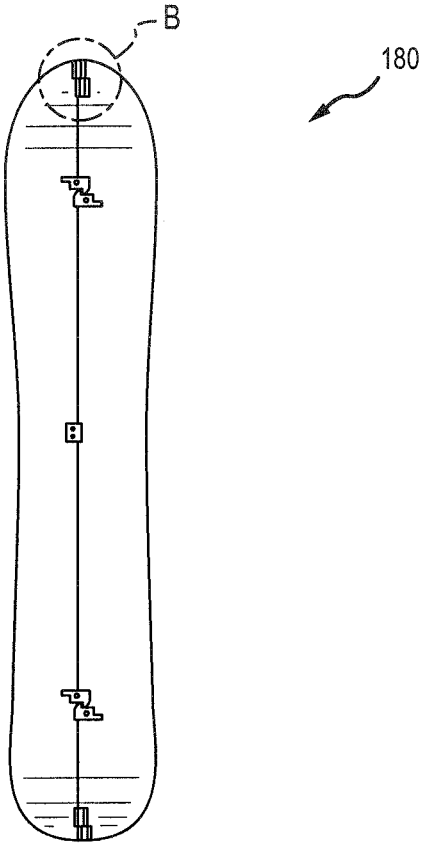
FIG. 14 illustrates a top view of a splitboard snowboard having a pin and bore connection in downhill mode in accordance with various embodiments.
Figure 15:
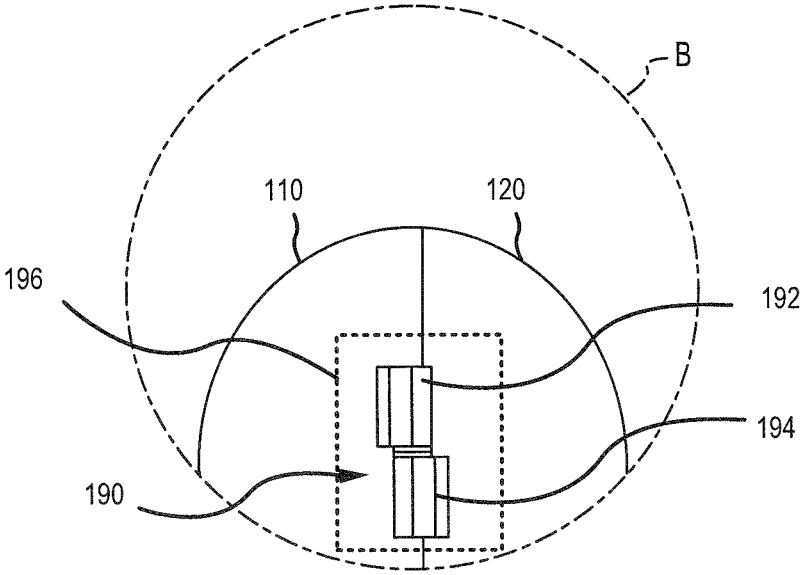
FIG. 15 illustrates a close up view of FIG. 14 in accordance with various embodiments.
Figure 16A:
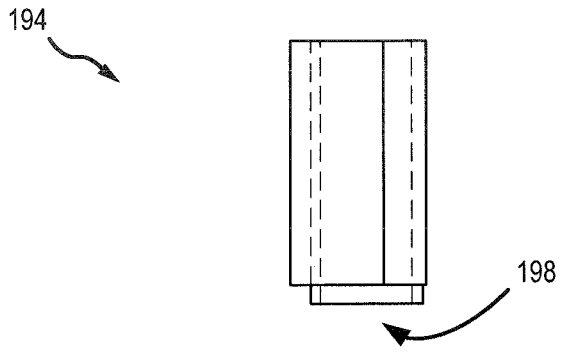
FIGS. 16A and 16B illustrate portions of a pin and bore connection in accordance with various embodiments.
Figure 16B:
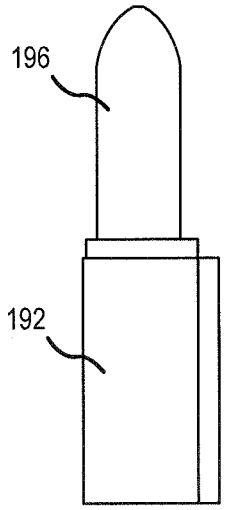

In various embodiments and with reference to FIGS. 12, 13A, and 13B, the present disclosure comprises a splitboard snowboard 160 with a shear tab connection 170. In various embodiments, the shear tab connection 170 prevents or minimizes shear and/or relative perpendicular flexion of the first splitboard ski 110 and the second splitboard ski 120 in downhill mode due to the stresses that cause the snowboard to flex and stress against each other. In various embodiments, the shear tab connection 170 locks the first splitboard ski 110 and the second splitboard ski 120 together to translate the forces incurred while riding in downhill mode across the entire plane of the snowboard rather than to each splitboard ski separately. In various embodiments, the splitboard snowboard 160 may further comprise an edge connection, as previously disclosed and described herein.

In various embodiments, the shear tab connection 170 may be disposed on a central portion 177 of the splitboard snowboard 160. However, in various embodiments, the shear tab connection 170 may be disposed at a first end 150, a second end 152, or anywhere therebetween. In various embodiments, the splitboard snowboard may comprise a plurality of shear tab connections.

In various embodiments, the shear tab connection 170 may be coupled to at least one of the first splitboard ski 110 and the second splitboard ski 120 via a mechanical connection. However, in various embodiments, the shear tab connection 170 may be an integral portion of at least one of the first splitboard ski 110 and the second splitboard ski 120. In various embodiments, the shear tab connection 170 may be disposed on the top surface 130 of the splitboard snowboard 160. In various embodiments, the shear tab connection 170 may be disposed within an inset portion 176 of the splitboard snowboard 160. In various embodiments, the inset portion 176 may comprise a depression in the top surface 130 of the splitboard snowboard 160 having a sufficient depth that the shear tab connection 170 does not extend perpendicularly above the top surface 130 of the splitboard snowboard 160.

In various embodiments, the shear tab 170 may comprise a shear tab 172 and at least on shear pin 174. In various embodiments, the shear tab 172 may be permanently coupled to at least one of the first splitboard ski 110 and the second splitboard ski 120. In various embodiments, the shear tab 172 may comprise one or more apertures configured to receive a shear pin 174. In various embodiments, at least one of the first splitboard ski 110 and the second splitboard ski 120 may comprise a one or more apertures. In various embodiments, the shear pin 174 may be configured to be placed through apertures of both the shear tab 172 and at least one of the first splitboard ski 110 and the second splitboard ski 120, thereby detachably coupling the first splitboard ski 110 to the second splitboard ski 120.

In various embodiments and with reference to FIGS. 14, 15, 16A, and 16B, the present disclosure comprises a splitboard snowboard 180 with a pin and bore connection 190. In various embodiments, the pin and bore connection may lock the first splitboard ski to the second splitboard ski at the tip, tail, and/or any section of the first interior wall and the second interior wall to keep the splitboard snowboard together and translate the energy from two separate skis to one solid splitboard snowboard.

In various embodiments, the pin and bore connection 190 comprises a pin tab 192 coupled to the first splitboard ski 110 and a bore tab 194 coupled to the second splitboard ski 120. In various embodiments, the individual skis of the splitboard snowboard 180 may slide longitudinally up or down, relative to one another, to engage the pin and bore connection 190.

In various embodiments, the pin tab 192 comprises protruding pin 196 that extends longitudinally along the splitboard snowboard 180 substantially in the direction of the bore tab 194. In various embodiments, the bore tab 194 comprises a bore 198 that extends longitudinally along the splitboard snowboard 180 substantially in the direction of the protruding pin 196. In various embodiments, the protruding pin 196 comprises a shape complementary to the bore 198 such that the protruding pin 196 may be inserted in the bore 198 thereby detachably coupling the first splitboard ski 110 to the second splitboard ski 120. In various embodiments, coupling of the protruding pin 196 and the bore 198 may create a friction fit. In various embodiments, the pin and bore connection may comprise a compression lock, ball bearing lock, ring lock, clasp lock, liner lock, or any suitable locking mechanism configured to detachably couple the protruding pin 196 and the bore 198. However, in various embodiments, the pin tab 192 and the bore tab 194 may be detachably coupled by magnetic, adhesive, mechanical, electromagnetic, or any other suitable means.

In various embodiments, the pin and bore connection 190 may be disposed at a first end 150 of the splitboard snowboard 180, a second end 152 splitboard snowboard 180, or anywhere therebetween. In various embodiments, the splitboard snowboard may comprise a plurality of pin and bore connections.

In various embodiments, the pin and bore connection 190 may be disposed on the top surface 130 of the splitboard snowboard 180. In various embodiments, the pin and bore connection 190 may be disposed within an inset portion 196 of the splitboard snowboard 180. In various embodiments, the inset portion 196 may comprise a depression in the top surface 130 of the splitboard snowboard 180 having a sufficient depth that the pin and bore connection 190 does not extend perpendicularly above the top surface 130 of the splitboard snowboard 180.

In various embodiments, the splitboard snowboard may comprise a pin and bore connection and a shear tab connection. In various embodiments, the splitboard snowboard may comprise an edge connection, a pin and bore connection, and a shear tab connection.

Figure 17A:
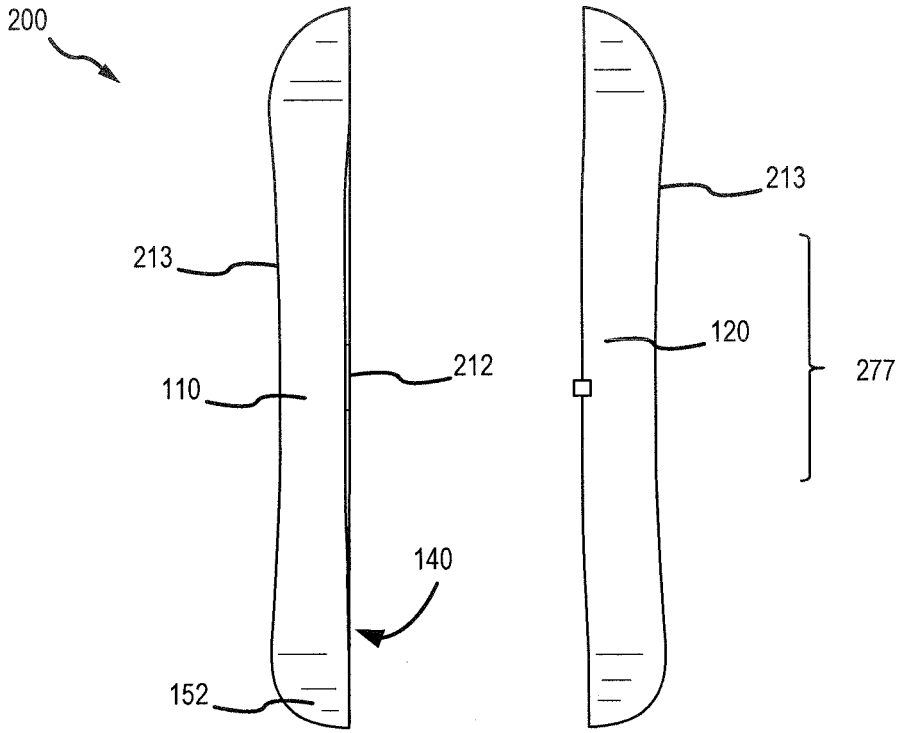
FIG. 17A illustrates a top view of a splitboard snowboard having a serrated edge in uphill mode in accordance with various embodiments.
Figure 17B:
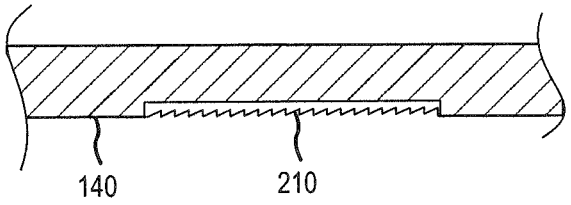
FIG. 17B illustrates a partial cross sectional view of FIG. 17A in accordance with various embodiments.

In various embodiments, a splitboard snowboard may further comprise a serrated edge. With reference to FIGS. 17A and 17B, in various embodiments, the serrated edge may comprise a plurality of serrated teeth configured to increase friction between a bottom surface 140 of the splitboard snowboard 200 and the ground, snow, and/or ice. In various embodiments, the plurality of serrated teeth may be disposed perpendicularly so as to increase friction between a bottom surface 140 of the splitboard snowboard 200 and the ground, snow, and/or ice. In various embodiments, the plurality of serrated teeth may be angled toward a second end 152 of the splitboard snowboard such that friction between a bottom surface 140 of the splitboard snowboard 200 and the ground, snow, and/or ice increases when a user travels uphill and decreases when a user travels downhill. However, in various embodiments, the plurality of serrated teeth may be disposed at any suitable angle.

In various embodiments, the serrated edge 210 may be disposed on an inner edge 212 of the splitboard snowboard 200. In various embodiments, the inner edge 212 may be disposed on an interior sidewall of at least one of the first splitboard ski 110 and the second splitboard ski 120. In various embodiments, splitboard snowboard 200 may comprise a serrated edge 210 on both the first splitboard ski 110 and the second splitboard ski 120.

In various embodiments, the inner edge 212 may be disposed in a central portion 277 of the splitboard snowboard 200. In various embodiments, the inner edge 212 may be disposed near the touring brackets of the splitboard snowboard 200. In various embodiments, the serrated edge 210 may be located not on an outer edge 213 of the splitboard snowboard 200. However, in various embodiments, the serrated edge 210 may be disposed on any suitable portion of the splitboard snowboard 200.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

I claim:

1. A snowboard comprising:

a first splitboard ski detachably coupled to a second splitboard ski by a splitlock connection system, the splitlock connection system comprising an edge connection;

wherein the edge connection is configured to prevent at least one of shear and relative perpendicular flexion of the first splitboard ski and the second splitboard ski.

2. The snowboard of claim 1, further comprising a serrated edge disposed on a bottom edge of a first interior sidewall of an inner edge of at least one of the first splitboard ski and the second splitboard ski.

3. The snowboard of claim 1, wherein the edge connection extends at least partially between a first end of the snowboard and a second end of the snowboard.

4. The snowboard of claim 3, wherein the edge connection comprises:

a first edge profile disposed on a first interior sidewall of the first splitboard ski; and a second edge profile disposed on a second interior sidewall of the second splitboard ski;

wherein the first edge profile comprises a shape complimentary to the second edge profile.

5. The snowboard of claim 4, wherein the edge connection comprises as least one of:

a bevel connection, a step connection, a notch connection, a knob connection, a v-nose connection, a round connection, and a tab and notch connection.

6. The snowboard of claim 4, wherein the edge connection comprises a twist lock connection, the twist lock connection comprising:

at least one twist lock notch disposed between a top surface and a bottom surface of the first splitboard ski and extending laterally from the first interior sidewall of the first splitboard ski;

at least one twist lock pin disposed in the at least one notch and extending perpendicularly; and at least one twist lock disposed at the second interior sidewall of the second splitboard ski;

wherein, in response to being rotated, the at least one twist lock is configured to at least partially insert into the at least one twist lock notch and detachably couple the twist lock to the at least one twist lock pin.

7. The snowboard of claim 1, further comprising a shear tab connection, wherein the shear tab connection comprises:

a shear tab coupled to the first splitboard ski and extending laterally over an inner edge of the first splitboard ski; and at least one shear pin detachably coupled to the shear tab and the second splitboard ski.

8. The snowboard of claim 7, wherein the shear tab is disposed on a top surface of the snowboard.

9. The snowboard of claim 7, further comprising:

an inset portion disposed on a top surface of the snowboard, wherein the shear tab is disposed in the inset portion.

10. The snowboard of claim 7, wherein the shear tab is disposed on a central portion of the snowboard.

11. A snowboard comprising:

a first splitboard ski detachably coupled to a second splitboard ski by a splitlock connection system, the splitlock connection system comprising at least one of an edge connection, and at least one pin and bore connection;

wherein at least one of the edge connection and the pin and bore connection is configured to prevent at least one of shear and relative perpendicular flexion of the first splitboard ski and the second splitboard ski.

12. The snowboard of claim 11, further comprising a serrated edge disposed on a bottom edge of an interior sidewall of at least one of the first splitboard ski and the second splitboard ski.

13. The snowboard of claim 11, wherein the edge connection extends at least partially between a first end of the snowboard and a second end of the snowboard.

14. The snowboard of claim 13, wherein the edge connection comprises:

a first edge profile disposed on a first interior sidewall of the first splitboard ski; and a second edge profile disposed on a second interior sidewall of the second splitboard ski;

wherein the first edge profile comprises a shape complimentary to the second edge profile.

15. The snowboard of claim 14, wherein the edge connection comprises as least one of:

a bevel connection, a step connection, a notch connection, a knob connection, a v-nose connection, a round connection, a tab and notch connection, and a twist lock connection.

16. The snowboard of claim 11, wherein the pin and bore connection comprises:

a pin tab coupled to the first splitboard ski at an interior sidewall of the first splitboard ski, wherein the pin tab comprises a protruding pin extending longitudinally along the snowboard; and a bore tab coupled to the second splitboard ski at an interior sidewall of the second splitboard ski, wherein the bore tab comprises a bore extending longitudinally along the snowboard;

wherein the protruding pin comprises a shape complementary to the bore; and wherein, in response to at least partially inserting the protruding pin into the bore, the first splitboard ski is detachably coupled to the second splitboard ski.

17. The snowboard of claim 16, wherein the pin and bore connection is disposed on a top surface of the snowboard.

18. The snowboard of claim 16, further comprising:

an inset portion disposed on a top surface of the snowboard, wherein the pin and bore connection is disposed in the inset portion.

19. The snowboard of claim 16, wherein a first pin and bore connection is disposed on a first end of the snowboard, and a second pin and bore connection is disposed on a second end of the snowboard.

20. A snowboard comprising:

a first splitboard ski detachably coupled to a second splitboard ski by a splitlock connection system, the splitlock connection system comprising an edge connection, and at least one of a shear tab connection, a pin and bore connection, and a serrated edge.

* * * * *